US012385259B2

(12) United States Patent
Meersseman et al.

(10) Patent No.: US 12,385,259 B2
(45) Date of Patent: Aug. 12, 2025

(54) FLOOR PANEL FOR FORMING A FLOOR COVERING

(71) Applicant: FLOORING INDUSTRIES LIMITED, SARL, Bertrange (LU)

(72) Inventors: Laurent Meersseman, Mont de l'Enclus (BE); Luc Vanhastel, Tielt (BE); Guy Van Hooydonck, Schoten (BE)

(73) Assignee: UNILIN, BV, Wielsbeke (BE)

( * ) Notice: Subject to any disclaimer, the term of this patent is extended or adjusted under 35 U.S.C. 154(b) by 14 days.

(21) Appl. No.: 18/299,495

(22) Filed: Apr. 12, 2023

(65) Prior Publication Data

US 2023/0243160 A1 Aug. 3, 2023

Related U.S. Application Data

(60) Continuation of application No. 17/332,141, filed on May 27, 2021, now Pat. No. 11,668,103, which is a (Continued)

(51) Int. Cl.
*E04F 15/02* (2006.01)
*E04F 15/10* (2006.01)

(52) U.S. Cl.
CPC ..... *E04F 15/02038* (2013.01); *E04F 15/102* (2013.01); *E04F 15/105* (2013.01); (Continued)

(58) Field of Classification Search
CPC . E04F 15/0203; E04F 15/105; E04F 15/0238; E04F 15/102; E04F 15/107; E04F 2201/08; E04F 2201/07; E04F 2201/026
See application file for complete search history.

(56) References Cited

U.S. PATENT DOCUMENTS 6,006,486 A 12/1999 Moriau et al.
6,023,907 A * 2/2000 Pervan ..... E04F 13/0801 52/480

(Continued)

FOREIGN PATENT DOCUMENTS

CN 101177970 A 5/2008
DE 102014002154 A1 8/2015

(Continued)

OTHER PUBLICATIONS

International Search Report from PCT Application No. PCT/IB2016/050231, Jun. 29, 2016.

*Primary Examiner* — Paola Agudelo
(74) *Attorney, Agent, or Firm* — Workman Nydegger

(57) ABSTRACT

A floor panel is of synthetic material and forms a layer-shaped substrate with first and second pairs of opposite edges. The first pair of opposite edges has coupling parts forming a first mechanical locking system, which, in a coupled condition of two of such floor panels, effects a locking in the plane of the floor panels and perpendicular to the respective edges, and forms a second mechanical locking system, which, in a coupled condition of two of such floor panels, effects a locking transverse to the plane of the panels. The coupling parts on the first pair of opposite edges are realized substantially in the material of the floor panel itself. The floor panel is provided with an edge configuration on the second pair of edges allowing two of such floor panels to be positioned with their respective edge alongside each other and free from mechanical horizontally active locking systems.

19 Claims, 6 Drawing Sheets

Related U.S. Application Data continuation of application No. 16/829,442, filed on Mar. 25, 2020, now Pat. No. 11,047,136, which is a continuation of application No. 16/440,515, filed on Jun. 13, 2019, now Pat. No. 10,697,185, which is a division of application No. 15/543,911, filed as application No. PCT/IB2016/050231 on Jan. 18, 2016, now Pat. No. 10,329,776.

(60) Provisional application No. 62/104,558, filed on Jan. 16, 2015.

(52) U.S. Cl.
CPC .... *E04F 15/107* (2013.01); *E04F 2201/0107* (2013.01); *E04F 2201/0138* (2013.01); *E04F 2201/0146* (2013.01); *E04F 2201/026* (2013.01); *E04F 2201/07* (2013.01); *E04F 2201/08* (2013.01)

(56) References Cited

U.S. PATENT DOCUMENTS

| | | | | |
|---|---|---|---|---|
| 6,119,423 | A | 9/2000 | Constantino | |
| 8,302,367 | B2 * | 11/2012 | Schulte | E04F 15/02 52/391 |
| 8,402,707 | B2 * | 3/2013 | Mitchell | E04F 13/18 52/287.1 |
| 8,793,959 | B2 | 8/2014 | Ruland | |
| 2003/0141004 | A1 | 7/2003 | Palmblad et al. | |
| 2004/0206036 | A1 | 10/2004 | Pervan | |
| 2006/0032168 | A1 | 2/2006 | Thiers et al. | |
| 2007/0175143 | A1 * | 8/2007 | Pervan | B44C 3/12 52/403.1 |
| 2008/0083182 | A1 | 4/2008 | Fletcher et al. | |
| 2009/0016817 | A1 | 1/2009 | Kulhawe et al. | |
| 2009/0049796 | A1 | 2/2009 | Grau | |
| 2009/0193741 | A1 | 8/2009 | Cappelle | |
| 2009/0199502 | A1 | 8/2009 | Eisermann | |
| 2011/0146177 | A1 | 6/2011 | Hannig | |
| 2013/0008118 | A1 | 1/2013 | Baert et al. | |
| 2013/0019456 | A1 * | 1/2013 | Heartsfield | E04F 15/105 24/592.1 |
| 2013/0104485 | A1 | 5/2013 | Meersseman et al. | |
| 2013/0139463 | A1 | 6/2013 | Delong | |
| 2013/0255174 | A1 | 10/2013 | Stafford et al. | |
| 2014/0033632 | A1 | 2/2014 | Chang | |
| 2014/0237931 | A1 * | 8/2014 | Pervan | E04F 15/02 52/747.11 |
| 2017/0009462 | A1 | 1/2017 | Muehlebach | |

FOREIGN PATENT DOCUMENTS

| | | | |
|---|---|---|---|
| WO | 9747834 | A1 | 12/1997 |
| WO | 2013050910 | A2 | 4/2013 |
| WO | 2013129892 | A1 | 9/2013 |

* cited by examiner

FLOOR PANEL FOR FORMING A FLOOR COVERING

CROSS-REFERENCE TO RELATED APPLICATIONS

This application is a continuation of U.S. non provisional application Ser. No. 17/332,141, filed May 27, 2021, which is a continuation of U.S. non provisional application Ser. No. 16/829,442 filed Mar. 25, 2020, which is a continuation of U.S. non provisional application Ser. No. 16/440,515 filed Jun. 13, 2019, now U.S. Pat. No. 10,697,185 issued Jun. 13, 2019, which is a divisional of the U.S. non provisional application Ser. No. 15/543,911 filed on Jul. 14, 2017, now U.S. Pat. No. 10,329,776 issued Jun. 25, 2019, which is a nationalization of International application No. PCT/IB2016/050231 filed Jan. 18, 2016, which claims the benefit under 35 U.S.C. 119(e) to the U.S. provisional application No. 62/104,558 filed on Jan. 16, 2015, each of which is incorporated herein by reference.

BACKGROUND OF THE INVENTION

Field of the Invention

This invention relates to a floor panel for forming a floor covering, more particularly for forming a floor covering which can be installed on an underlying surface, wherein the floor panels substantially are realized on the basis of synthetic material and preferably are realized as a layer-shaped, either single-layer or multi-layer, substrate.

More particularly, it relates to floor panel which can be coupled to each other at least on certain edges.

SUMMARY OF THE DISCLOSURE

The aim of the invention is that such floor covering is easy to install, this as a result of the claimed combination of characteristics of the floor panels, and/or that, in comparison with existing floor panels, advantageous characteristics after installation are obtained and/or that the floor panels can be realized in a simple manner, for example, by applying less complex profiled edge parts on at least one pair of the edges. The invention primarily aims at offering compromises between coupling systems on a first pair of edges and a second pair of edges, whereby a user-friendly product is achieved which, however, remains effective in its use.

To this aim, the invention relates to floor panels such as described herein below, wherein according to five independent aspects various advantageous embodiments are offered.

Herein, it is noted that the herein below also described sub-characteristics of each of the aspects may be applied at choice as sub-characteristics of the other aspects, such in as far as this is not contradictory.

According to the first of said five aspects, the invention relates to a floor panel for forming a floor covering, wherein this floor panel is realized substantially on the basis of synthetic material and preferably as a layer-shaped, either single-layer or multi-layer, substrate; wherein this floor panel is rectangular, either oblong or square, and thus comprises a first pair of opposite edges and a second pair of opposite edges; wherein the first pair of opposite edges comprises coupling parts, which allow that a plurality of such floor panels mutually can be coupled to each other; wherein these coupling parts form a first mechanical locking system, which, in a coupled condition of two of such floor panels, effects a locking in the plane of the floor panels and perpendicular to the respective edges, as well as form a second mechanical locking system, which, in a coupled condition of two of such floor panels, effects a locking transverse to the plane of the panels; wherein these coupling parts, on the first pair of opposite edges, preferably are realized substantially in the material of the floor panel itself, and more particularly in said substrate; with the characteristic that the floor panel, on the second pair of edges, is provided with an edge configuration which allows that two of such floor panels can be positioned with their respective edges alongside each other, wherein the configuration of the edges is free from mechanical horizontally active locking systems. This aspect offers the advantage that the motion in the material during shrinkage and expansion of the floor panel can easily be accommodated, and there are no horizontally active locking means which might be pushed out of each other.

According to a preferred embodiment, the floor panel of the first aspect further is characterized in that the second pair of edges is also free from mechanical vertically active locking systems.

In the preceding, two possibilities may be provided. According to a first possibility, the floor panel is characterized in that, on the second pair of edges, it has an edge configuration which provides for that the actual panels in installed condition extend along these edges in a non-overlapping manner alongside each other, more particularly can adjoin each other exclusively by butt joint.

According to a second preferred possibility, the floor panel is characterized in that, on the second pair of edges, it has an edge configuration which provides for that the actual panels in installed condition extend along these edges alongside each other in an overlapping manner.

The overlapping may show various characteristics, such as:

- the overlapping is obtained by means of a lower flange and upper flange at opposite edges of the second pair;
- the overlapping makes use of substantially flat flanges;
- each of the flanges has a thickness larger than ⅓ of the overall thickness of the floor panel;
- the flanges are realized in one piece with the floor panel;
- the lower flange is realized as a separate part and attached to the floor panel, preferably partially on the lower side thereof, possibly in a recess to this aim;
- the overlapping is made possible in that on one of the edges of the second pair of edges, a protruding flap is provided, which is attached to the lower side of the floor panel, on which, in installed condition, another panel simply is placed;
- said flap is realized as a strip of a foil-like or film-like material;
- the overlapping extends transverse in respect to the edge over a distance which is larger than the thickness of the floor panel, and still better larger than twice the thickness and still better at least five times the thickness;
- the overlapping allows contact at the upper edges;
- in the normal mounted condition, there is a space between the floor panels at the bottom side at the overlapping edges;
- in the normal mounted condition, there is no space between the floor panels at the bottom side at the overlapping edges.

According to a preferred embodiment, the floor panel further is characterized in that the edge configuration of the second pair of edges is completely free from locking systems, thus, also from connection systems other than mechanical locking systems, such as adhesive means or the like. According to a possibility, then at least one of the edges of the second pair is provided with a seat, such as a recess or the like, for applying an adhesive, such as glue, during installation of the floor panels.

According to another possibility, the floor panel of the first aspect is characterized in that the edge configuration of the second pair of edges is provided with adhesive means, which allow a connection between the edges. Various possibilities are described in the detailed description and in the claims.

According to a second independent aspect, the invention relates to a floor panel for forming a floor covering, wherein this floor panel is realized substantially on the basis of synthetic material and preferably as a layer-shaped, either single-layer or multi-layer, substrate; wherein this floor panel is rectangular, either oblong or square, and thus comprises a first pair of opposite edges and a second pair of opposite edges, wherein in the case of an oblong floor panel the second pair of edges is formed by the short sides; wherein the first pair of opposite edges comprises coupling parts, which allow that a plurality of such floor panels mutually can be coupled to each other; wherein these coupling parts form a first mechanical locking system, which, in a coupled condition of two of such floor panels, effects a locking in the plane of the floor panels and perpendicular to the respective edges, as well as form a second mechanical locking system, which, in a coupled condition of two of such floor panels, effects a locking transverse to the plane of the panels; wherein these coupling parts, on the first pair of opposite edges, preferably are realized substantially in the material of the floor panel itself, and more particularly in said substrate; characterized in that the floor panel, on the second pair of edges, is provided with coupling parts which allow that such floor panels mutually can be coupled to each other; wherein these coupling parts form a mechanical locking system, which, in a coupled condition of two of such floor panels, provides at least for a locking in horizontal direction, as well as comprise an adhesive means, which offers an additional connection which is at least active in vertical direction.

According to its third aspect, the invention relates to a floor panel for forming a floor covering, wherein this floor panel substantially is realized on the basis of synthetic material and preferably as a layer-shaped, either single-layer or multi-layer, substrate; wherein this floor panel is rectangular, either oblong or square, and thus comprises a first pair of opposite edges and a second pair of opposite edges; wherein the first pair of opposite edges comprises coupling parts, which allow that a plurality of such floor panels mutually can be coupled to each other; wherein these coupling parts form a first mechanical locking system, which, in a coupled condition of two of such floor panels, effects a locking in the plane of the floor panels and perpendicular to the respective edges, as well as form a second mechanical locking system, which, in a coupled condition of two of such floor panels, effects a locking transverse to the plane of the panels; wherein these coupling parts, on the first pair of opposite edges, preferably are realized substantially in the material of the floor panel itself, and more particularly in said substrate; wherein the coupling parts of the first pair of opposite edges are configured such that two of such panels can be coupled to each other at these edges by means of a turning movement, characterized in that coupling parts on the second pair of edges are free from mechanical vertically active locking systems or parts, and more particularly are realized as a so-called drop-in system, wherein the sole mechanical locking system is a mechanical horizontally active locking system, and that the coupling parts comprise one or more inclined and/or rounded edges, which function as locating edges or locating surfaces.

According to a fourth aspect, the invention provides for a floor panel for forming a floor covering, wherein this floor panel substantially is realized on the basis of synthetic material and preferably as a layer-shaped, either single-layer or multi-layer, substrate; wherein this floor panel is rectangular, either oblong or square, and thus comprises a first pair of opposite edges and a second pair of opposite edges, wherein in the case of an oblong panel, the second pair of edges forms the short sides; wherein the second pair of opposite edges comprises coupling parts, which allow that a plurality of such floor panels mutually can be coupled to each other; wherein these coupling parts form a first mechanical locking system, which, in a coupled condition of two of such floor panels, effects a locking in the plane of the floor panels and perpendicular to the respective edges, as well as form a second mechanical locking system, which, in a coupled condition of two of such floor panels, effects a locking transverse to the plane of the panels; wherein these coupling parts allow coupling by means of a turning movement; characterized in that on the first pair of sides coupling parts are present, selected from coupling parts of the drop-in type, push-lock type, or of the type with overlapping portions with adhesive, in such a manner that such floor panel first can be coupled on one edge of the second pair to a preceding floor panel in the same row and subsequently, via a downward movement, can be coupled with an edge of the first pair to one or more floor panels of a preceding row, this latter preferably by means of a rolling movement.

According to a fifth independent aspect, the invention relates to a floor panel for forming a floor covering, wherein this floor panel substantially is realized on the basis of synthetic material and preferably as a layer-shaped, either single-layer or multi-layer, substrate; wherein this floor panel is rectangular, either oblong or square, and thus comprises a first pair of opposite edges and a second pair of opposite edges; wherein the first pair of opposite edges as well as the second pair of opposite edges comprises coupling parts, which allow that a plurality of such floor panels mutually can be coupled to each other; wherein these coupling parts form a first mechanical locking system, which, in a coupled condition of two of such floor panels, effects a locking in the plane of the floor panels and perpendicular to the respective edges, as well as form a second mechanical locking system, which, in a coupled condition of two of such floor panels, effects a locking transverse to the plane of the panels; characterized in that the floor panel, on at least one pair of edges, comprises "velcro"-type fastening parts as a vertically active locking system, whether or not combined with further mechanical locking systems.

In a preferred embodiment, the floor panel of the fifth aspect is characterized in that it shows one or more of the following characteristics:

- the "velcro"-type fastening parts make use of a plurality of separate small "velcro"-type fastening elements;
- the "velcro"-type fastening parts make use of a plurality of profile-shaped "velcro"-type fastening elements;
- the "velcro"-type fastening parts make use of "velcro"-type straps, possibly countersunk in a recess;
- the "velcro"-type fastening parts are formed in one piece in the material of the floor panel;
- the "velcro"-type fastening parts are active between overlapping flanges;

the floor panels are realized as a fold-down system, wherein the "velcro"-type fastening parts are present exclusively on the pair of edges which are joined via the downward movement, more particularly on the short edges.

More specific characteristics of one or more of the aforementioned aspects are defined in the detailed description following below and/or in the appended claims.

It is noted that by "mechanically horizontally or vertically active locking systems", systems are understood wherein a locking is achieved solely via mechanically locking surfaces. An adhesive connection does not fall in this category, even if the adhesive, in solidified condition or otherwise, should form a locking surface.

Pure friction also is not considered a mechanically active locking system.

A horizontally active locking system is a system in which two floor panels, if they are moved out of each other in the same plane, are counteracted and/or restricted therefrom.

A vertically active locking system is a system, which prevents that two coupled floor panels can be moved out of each other vertically, or at least counteracts this movement.

BRIEF DESCRIPTION OF THE DRAWINGS

With the intention of better showing the characteristics of the invention, herein below, as an example without any limitative character, some preferred embodiments are described, with reference to the accompanying drawings, wherein.

DETAILED DESCRIPTION OF PREFERRED EMBODIMENTS OF THE INVENTION

The figures are schematic representations which are self-evident. Herein, the figures, such as mentioned herein above, relate to five aspects, which also have been explained in the introduction. The general references P1 and P2 in the figures refer to the first pair of edges and second pair of edges, respectively. Reference A schematically represents an adhesive means or the like, whereas reference Z refers to locating edges.

The various cross-sectional views substantially have the purpose of visualizing the principles of the locking in certain directions or not locking in certain directions.

Figure 1:
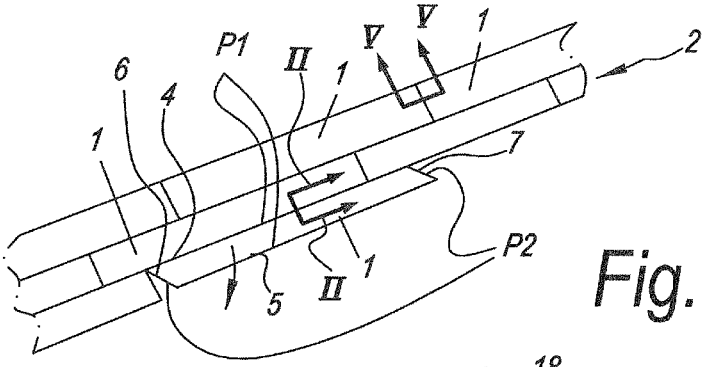
FIGS. 1 to 22 are schematic representations of floor panels and their edge portions, wherein these schematic representations illustrate various embodiments of the first aspect of the invention.
Figure 2:
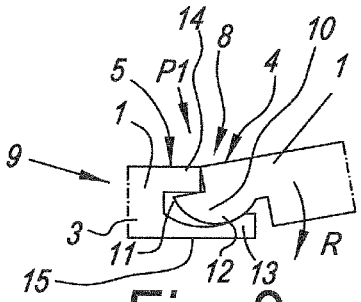
Figure 3:
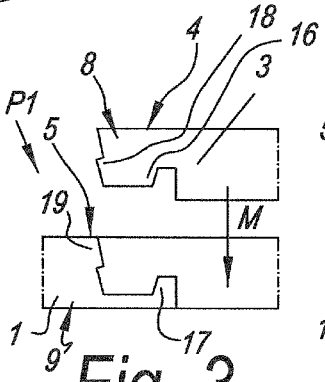
Figure 4:
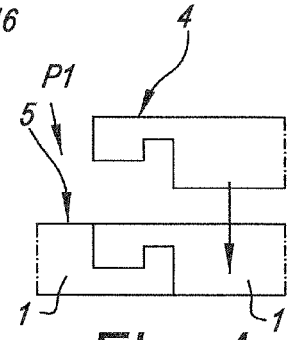
Figure 5:
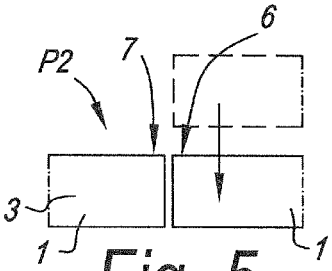

So, for example, FIGS. 1 to 3 represent three principal possibilities of interconnecting edges of the first pair P1, whereas FIGS. 5 to 22 represent a number of principal possibilities for the second pair P2. FIG. 2 thus forms a cross-section according to line II-II in FIG. 1, whereas the FIGS. 3 and 4 represent variants thereof. FIG. 5 is a cross-section according to line V-V in FIG. 1, whereas FIGS. 6 to 22 are variants of this cross-section.

Herein below, the various aspects of the invention will be explained in greater detail.

The first aspect is explained herein below by means of FIGS. 1 to 22, which schematically represent some examples.

According to this first aspect, the invention relates to a floor panel 1 for forming a floor covering 2, wherein this floor panel 1 is realized substantially on the basis of synthetic material and preferably as a layer-shaped, either single-layer or multi-layer, substrate 3; wherein this floor panel 1 is rectangular, either oblong or square, and thus, as indicated in FIG. 1, comprises a first pair of opposite edges P1 and a second pair of opposite edges P2. The first pair P1 is formed by the edges 4 and 5, whereas the second pair P2 is formed by the edges 6 and 7.

Still according to the first aspect, the first pair of opposite edges 4-5, as in the examples of FIGS. 2 and 3, comprises coupling parts 8-9, which allow that a plurality of such floor panels 1 mutually can be coupled to each other; wherein these coupling 8-9 parts form a first mechanical locking system and a second mechanical locking system. The first mechanical locking system is of such kind that, in a coupled condition of two of such floor panels, it effects a locking in the plane of the floor panels and perpendicular to the respective edges, in other words, provides for a horizontal locking, wherein the shifting apart of the floor panels according to a direction transverse to their edges is counteracted. The second mechanical locking system is of such kind that, in a coupled condition of two of such floor panels, it effects a locking transverse to the plane of the panels, in other words, provides for a vertical locking. Herein, the coupling parts, on the first pair of opposite edges, preferably are realized substantially in the material of the floor panel itself, and more particularly in said substrate 3.

It is noted that such coupling parts 8-9, which in coupled condition provide for a mechanical locking in horizontal as well as vertical direction, can be realized in different manners and are not limited to the embodiments of the FIGS. 2 and 3. The embodiments of FIGS. 2 and 3, however, will be explained below in a short version.

According to FIG. 2, coupling parts 8-9 of the first pair of opposite edges are configured such that two of such panels 1 on these edges can be coupled to each other by means of a turning movement R. In the example, the coupling parts 8-9 on the first pair of opposite edges to this aim consist of a tongue 10 and a groove 11, as well as of locking parts 12-13, which, in the coupled condition, prevent the shifting apart of the tongue and groove. Herein, the groove 11 preferably is bordered by an upper lip 14 and a lower lip 15, which latter in distal direction reaches farther than the upper lip, in other words, protrudes to beyond the upper lip. The locking part 12 is situated on the lower side of the tongue, whereas the locking part 13 is formed on the protruding part of the lower lip 15.

It is noted that, in the case that, as aforementioned, the first pair of opposite edges is configured such that two of such panels 1 can be coupled to each other at these edges by means of a turning movement R, it is preferred that the second pair of edges is configured such that successively floor panels simply can be installed via a fold-down principle, such as further will become clear from the description of the second pair of edges. In the present application, by the "fold-down principle" must be understood that, when a newly to install floor panel is coupled to a preceding row of floor panels via said turning movement R, this movement also automatically has the final effect that the newly installed floor panel will arrive with its third or fourth edge in the intended end position in respect to the fourth or third edge of the preceding floor panel of the same row. According to the present patent application, the "fold-down principle" thus not necessarily implies that a vertical locking between the third and fourth edge of the adjacent floor panels must be achieved.

FIG. 3 shows another possibility for the edges 2 and 3. Hereby, these edges are provided with coupling parts 8-9, which in this case, too, form a first mechanical locking system, which, in the coupled condition of two of such floor panels, effects a locking in the plane of the floor panels and perpendicular to the respective edges, as well as form a second mechanical locking system, which, in a coupled condition of two of such floor panels, effects a locking transverse to the plane of the panels; wherein these coupling parts, on the first pair of opposite edges, as represented, preferably are realized substantially in the material of the floor panel itself, and more particularly in said substrate. The specific characteristic of the coupling parts of FIG. 3 consists in that the respective edges 4 and 5 can be joined together by means of a downward movement M of one panel in respect to the other, this whereas therein a locking in horizontal as well as in vertical direction is achieved. Said first locking system, which provides for the horizontal locking, is formed in that the coupling parts 8-9 are realized as hook-shaped elements with locking parts 16-17, which engage behind each other as a result of the downward movement M. The second locking system, which provides for the vertical locking, is formed by locking parts 18-19, which hook behind one another, which engage behind each other by means of a snap action. It is noted that the locking parts 18-19, viewed in cross-section, can also be present on other locations on the coupling parts.

In FIG. 4, a deviating embodiment for the coupling parts of the edges 4-5 is represented, to which will be returned further in de description, According to a characteristic of the first aspect of the invention, such floor panel is characterized in that the floor panel, on the second pair of edges, is provided with an edge configuration which allows that two of such floor panels 1 can be positioned with their respective edges 6-7 alongside each other, wherein the configuration of the edges is free from mechanical horizontally active locking systems. FIGS. 5 to 22, which are self-evident, represent various embodiments of edges 6-7 of the second pair P2 which fulfill this.

According to a particular possibility of the first aspect of the invention, the second pair of edges is also free from mechanical vertically active locking systems. The embodiments of FIGS. 5 to 14 also fulfill this.

In FIG. 5, an embodiment is represented wherein the floor panel, on the second pair of edges 6-7, has an edge configuration which provides for that the actual panels in installed condition extend along these edges in a non-overlapping manner alongside each other, more particularly can adjoin each other exclusively by butt joint.

In FIGS. 6 to 9, embodiments are represented wherein the floor panel, on the second pair of edges, has an edge configuration which provides for that the actual panels extend along these edges 6-7 alongside each other in an overlapping manner, thus for embodiments which also are characterized in that the edge configuration of the second pair of edges is entirely free from locking systems, thus, also is also free from other locking systems than mechanical locking systems, such as adhesive means or the like.

As represented in FIGS. 6 to 9, the overlapping preferably is realized by means of an upper flange 20, which, partially or completely, overlaps a lower flange 21, wherein the upper flange 20 preferably rests on the lower flange 21.

Figure 6:
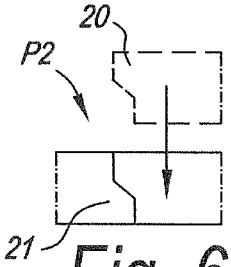

FIG. 6 represents an example with flanges 20-21, which come into mutual contact via inclined surfaces.

Preferably, however, use shall be made of flat flanges. FIGS. 3 to 7 are three examples thereof.

It is noted that the flanges 20-21 preferably have a thickness which is larger than ⅓ of the overall thickness of the floor panel.

Figure 7:
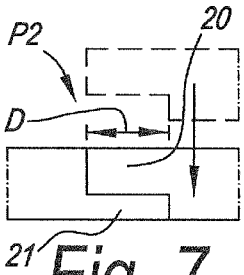
Figure 8:
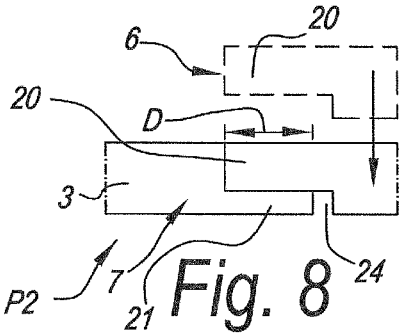

FIGS. 6 to 8 illustrate that the flanges can be realized in one piece. According to an alternative, which is represented in FIG. 9, the lower flange forms part of a separate part 22, for example, in the form of a strip, which is attached to the floor panel, in this case in a recess 23.

Figure 9:
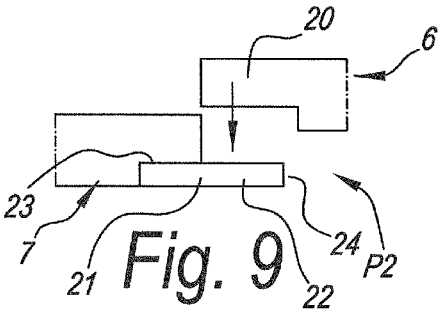

The embodiments of FIGS. 7 to 9 also illustrate that, seen in cross-section, the overlapping extends over a distance D which is larger than the overall thickness of the floor panel.

As represented in FIGS. 8 and 9, a space 24 can be present at the bottom side, distally from the lower flange 21. Alternatively, no space is present, such as in the embodiment of FIGS. 6 and 7.

In general, the overlapping indeed shall be realized such that the floor panels in installed condition adjoin against each other in the proximity of their upper edges.

In FIGS. 10 to 14, some embodiments of the first aspect of the invention are represented, wherein the edges 6-7 also are free from mechanical vertically active locking parts, however, wherein indeed use is made of an adhesive means A, which realizes a connection between the edges. Herein, this relates to an adhesive means which is already present on the floor panels beforehand. In the represented examples, the adhesive means A beforehand is present on one edge; however, it is clear that instead thereof, it might also be present on the other edge or may even be present on both edges. In the latter case, it is preferred that in the installed condition, the adhesive means come into contact with each other.

Figure 10:
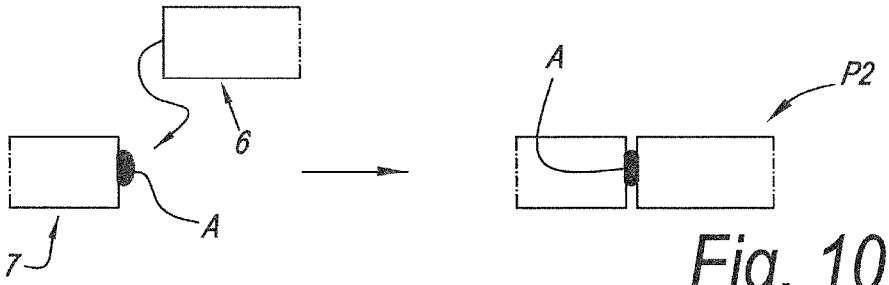
Figure 11:
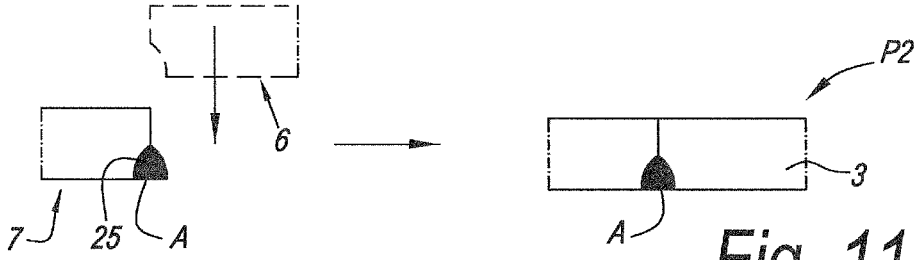

In FIG. 10, the edges 6-7 have a non-overlapping form, and an adhesive means A is present on the side of one edge. FIG. 11 represents a variant, wherein the adhesive means A is provided in a seat 25 at the bottom and protrudes beyond the edge of the floor panel and in this manner a subsequent floor panel, during the installation thereof, can come into contact with this adhesive means A.

Figure 12:
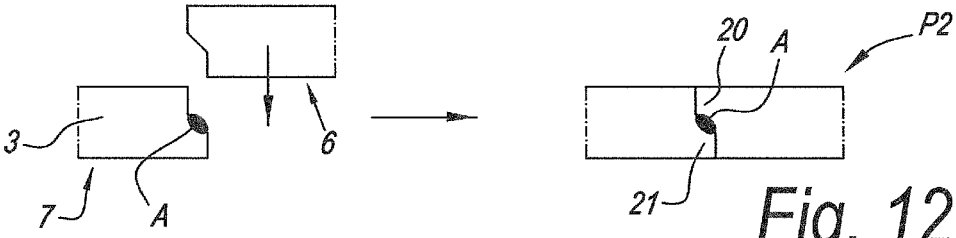
Figure 13:
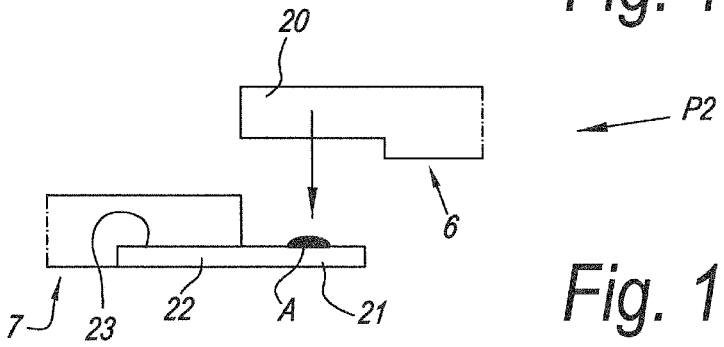
Figure 14:
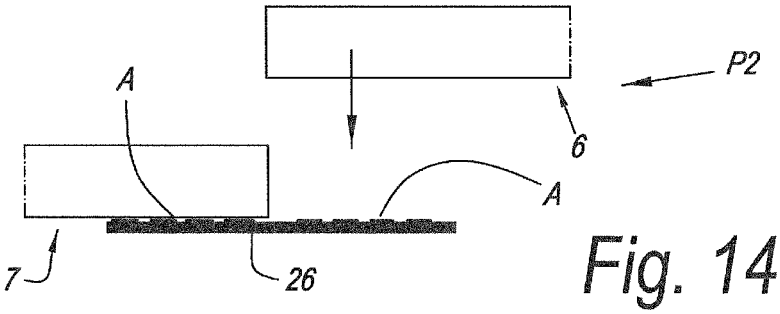

FIGS. 12 to 14 represent embodiments which fulfill the first aspect of the invention, however, therein also make use of an overlapping configuration, combined with the presence of adhesive. In the embodiments of FIGS. 12 and 13, the adhesive means A is present on the lower flange 21. In FIG. 13, a separate part 22 is applied, analogous to FIG. 9.

In FIG. 14, an embodiment is represented wherein the overlapping is realized in that on one of the edges of the second pair of edges a protruding flap 26 is provided, which is attached to the lower side of the floor panel 1. The adhesive means A is present on the lower flange. The protruding flap is formed as a strip of a foil-like or film-like material and is attached to the lower side of the floor panel, for example, also by means of an adhesive, for which purpose possibly the same adhesive means A can be applied.

According to a not represented alternative, such lower flange also may be formed by a foil which is present on the lower side of the floor panel in an uninterrupted manner, for example, a backing layer which extends farther than the substrate itself.

As explained in the introduction, various types of adhesive can be applied for the herein above-mentioned adhesive means A; however, preferably use is made of a pressure-sensitive adhesive or glue.

FIGS. 15 to 22 represent various embodiments of the first aspect of the invention, wherein the second pair of edges 6-7 now indeed is provided with a vertically active locking system, which is formed by mutually cooperating locking parts 27-28. Preferably, however, not necessarily, this relates to locking parts which can be forced into their coupled condition simply by deformation, such that an installation by fold-down remains possible.

Figure 15:
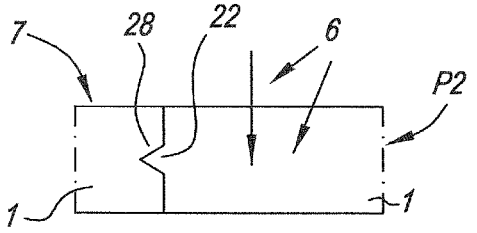
Figure 16:
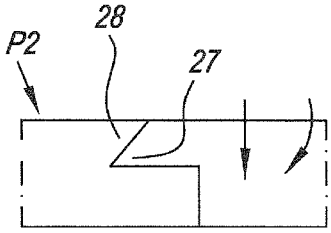
Figure 17:
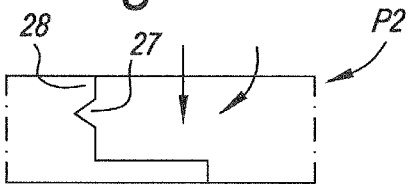
Figure 18:
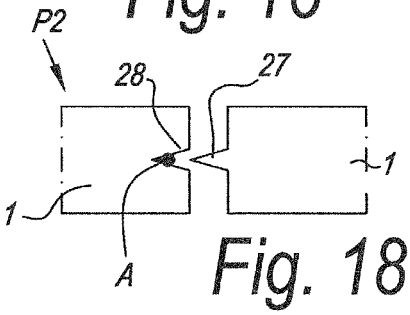
Figure 19:
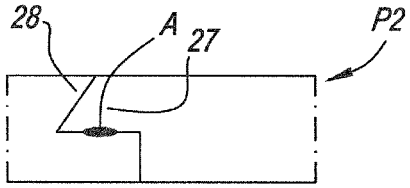
Figure 20:
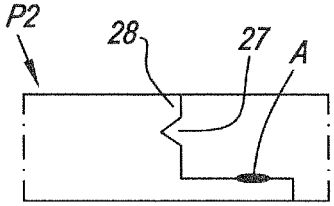
Figure 21:
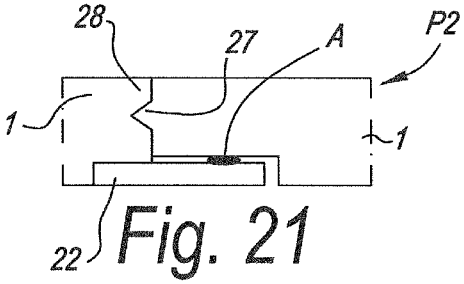
Figure 22:
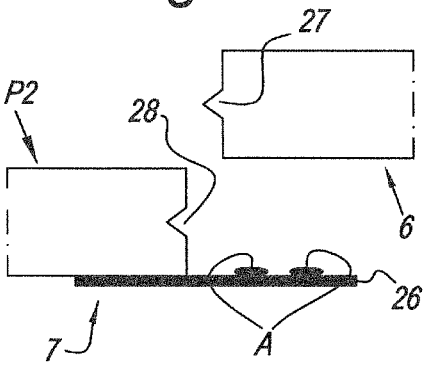

FIGS. 15 to 17 show embodiments without adhesive means, whereas FIGS. 18 to 22 provide for embodiments which indeed make use of adhesive means A.

In a particular deviating embodiment of the first aspect, this is characterized in that on the first pair of edges the aforementioned second locking system is absent and preferably the coupling parts are realized exclusively from a so-called drop-in system, whether or not combined with an adhesive means. FIG. 4 represents an example hereof. It is clear that all herein above and herein below described coupling parts for the second pair of edges can also be applied in the same floor panel in combination with such drop-in system on the first pair of edges.

As is evident in FIG. 1, it is preferred that the floor panel is rectangular and oblong and that the aforementioned pair of edges is formed by the edges which form the long sides, and the second pair of edges is formed by the edges which form the short sides.

Figure 23:
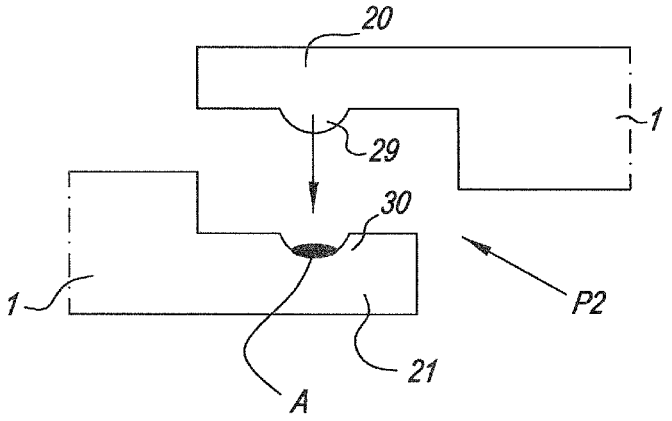
FIGS. 23 and 24 illustrate two embodiments of the second aspect.
Figure 24:
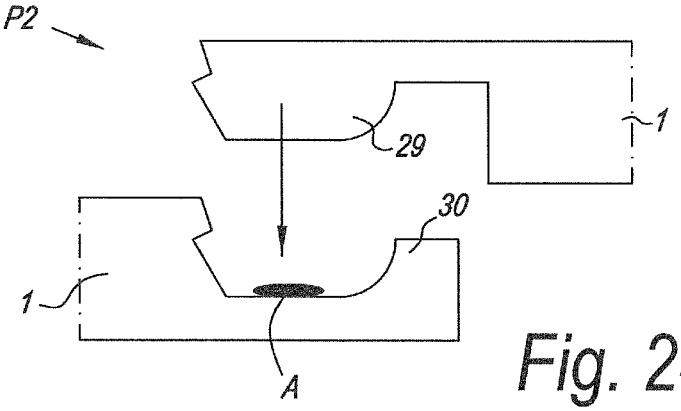

FIGS. 23 and 24 illustrate two embodiments of the second pair of edges 6-7 of floor panels which are realized according to the second aspect of the invention. De mechanical locking in horizontal direction herein is obtained by locking parts 29-30, which engage behind each other.

In FIG. 23, a drop-in system is applied, whereas in FIG. 24 a so-called push-lock system is applied. In a drop-in system, there is no vertical locking. In a push-lock system, there is a vertical locking indeed.

Figure 25:
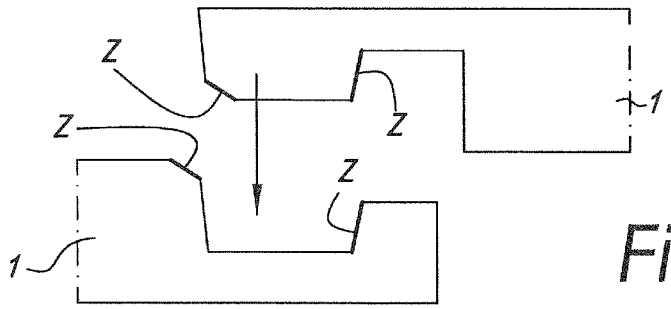
FIG. 25 illustrates the third aspect of the invention.
Figure 26:
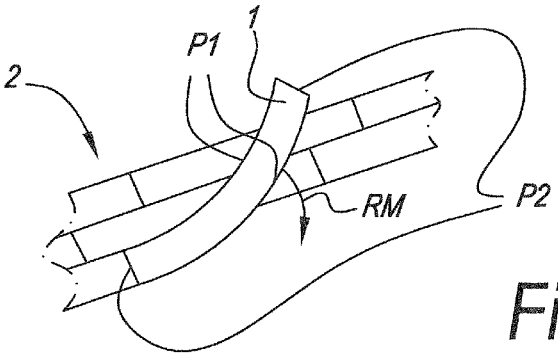
FIGS. 26 to 30 illustrate various embodiments according to the fourth aspect of the invention.

FIG. 25 shows an example of the second pair of edges of a floor panel which is realized according to the third aspect of the invention, wherein the intended locating edges are realized as Z.

Figure 27:
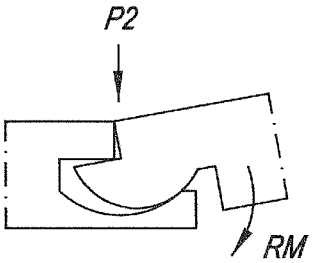
Figure 28:
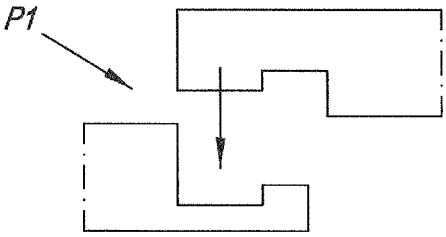
Figure 29:
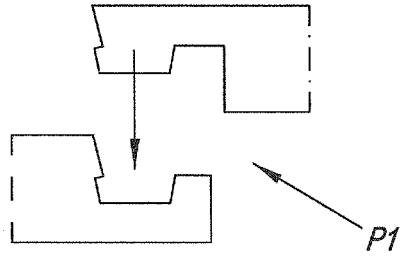
Figure 30:
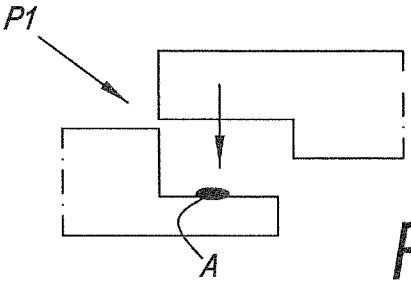

FIGS. 26 to 30 illustrate the fourth aspect of the invention for oblong floor panels 1. On the second pair of edges P2, now, as represented in FIG. 27, coupling parts are applied which allow a coupling by means of a turning movement. On the first pair of edges, coupling parts are applied selected from coupling parts of the drop-in type, push-lock type or of the type with overlapping portions with adhesive means, in such a manner that such floor panel first can be coupled on an edge of the second pair to a preceding floor panel in the same row and subsequently, via a downward movement, can be coupled with an edge of the first pair to one or more floor panels of a preceding row, this latter preferably by means of a rolling movement RM. Examples of the aforementioned three types of coupling parts are represented in FIGS. 28, 29 and 30, respectively.

Figure 31:
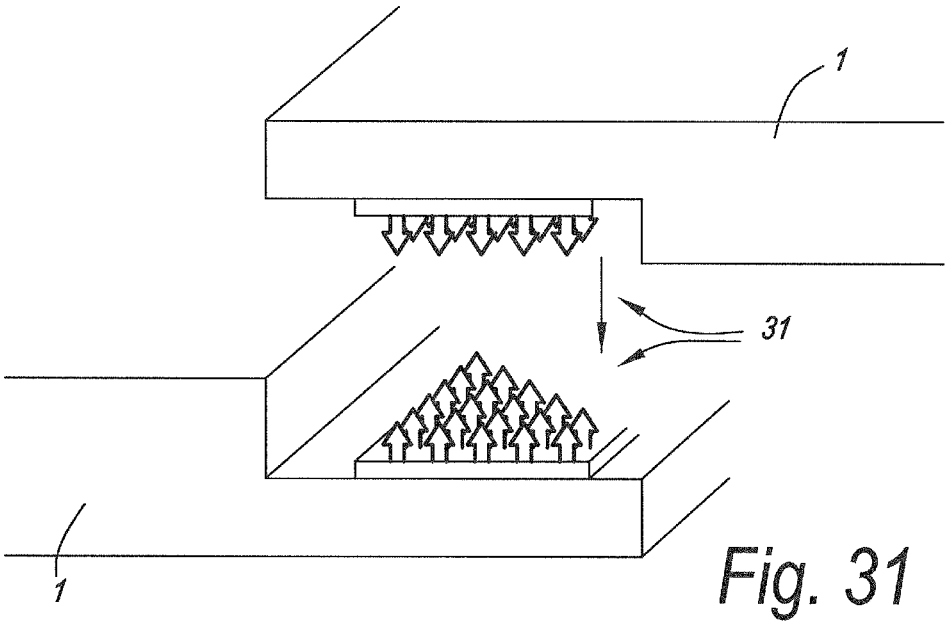
FIGS. 31 to 33 schematically represent portions of three floor panels which are realized according to the fifth aspect of the invention.
Figure 32:
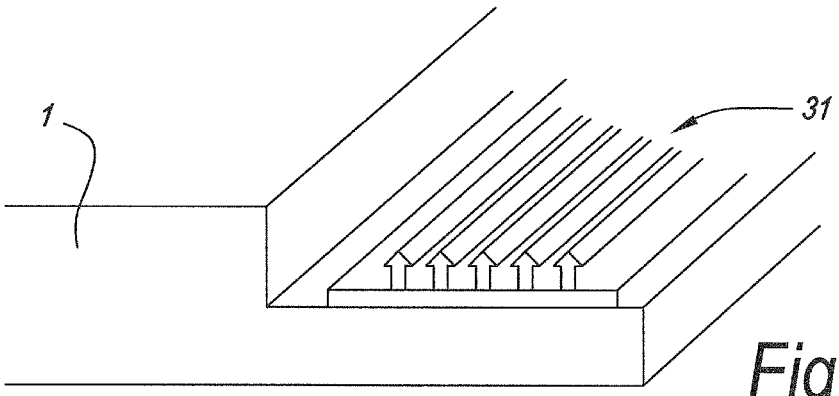
Figure 33:
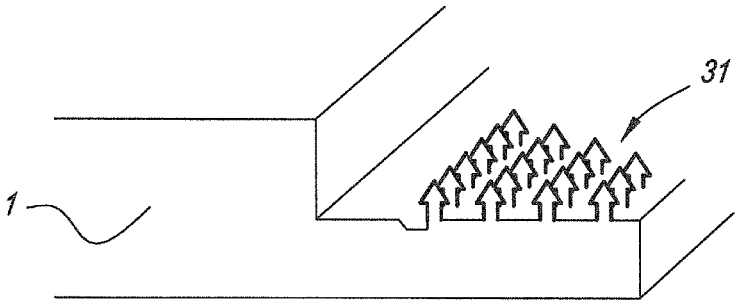

Finally, FIGS. 31, 32 and 33 show three embodiments of edges which are equipped with "velcro"-type fastening parts and which are suitable for application in a floor panel according to the fifth aspect.

In the embodiment of FIG. 31, use is made of "velcro"-type fastening parts 31, die make use of a plurality of small separate "velcro"-type fastening elements.

In FIG. 32, use is made of at least one "velcro"-type fastening part with a plurality of profile-shaped "velcro"-type elements.

In the embodiment of FIG. 33, the "velcro"-type fastening parts are formed in one piece in the material of the floor panel.

As becomes evident from the examples, it is generally preferred that the "velcro"-type fastening parts are active between overlapping flanges. Preferably, no other mechanical vertically active locking systems are applied therewith. Moreover, it is also preferred that no other horizontally active locking systems are applied therewith. For the first pair of edges, preferably coupling parts are applied of the type such as in FIG. 2 or 3, thus, coupling parts which can be joined into each other by a turning movement R or a downward movement M.

It is clear that according to the invention primarily decorative floor panels are concerned, thus, with a decorative upper side, for forming a floor covering on an existing supporting floor, and more particularly for forming a floating floor covering.

The invention is in particular intended for floor panels which substantially consist of synthetic material, or which comprise at least one or more basic layers on the basis of synthetic material, and more particularly with floor panels of the supple type.

Still more particularly, the invention shows its advantages best with vinyl panels, in particular so-called vinyl tiles, and in particular with panels of the so-called LVT type ("Luxury Vinyl Tile") or VCT type ("Vinyl Composite Tile", also called "Vinyl Composition Tile"). Of course, also comparable panels of other synthetic materials, such as PU, are applicable.

Such synthetic material floor panel, and in particular supple synthetic material floor panel, and more particularly such vinyl tile, preferably shows one of the following characteristics:

- the floor panel is substantially composed of one or more basic layers and at least a top layer, wherein the top layer as such may or may not be composed of a plurality of layers;
- herein, the top layer comprises at least a decorative layer, preferably in the form of a print, preferably provided on a foil or film;
- the top layer comprises at least a translucent or transparent wear layer;
- the floor panel is substantially composed of a thermoplastic material, preferably a soft thermoplastic material;
- the floor panel, or anyhow at least the one or more basic layers thereof, is/are substantially composed of polyvinyl chloride, more particularly of soft polyvinyl chloride, more particularly provided with plasticizers or the like; a composition "substantially" on the basis of PVC is to be interpreted broadly, as a large number of additives, for example, fillers, can be employed in PVC floors;
- the floor panel comprises at least one reinforcement layer, preferably formed of fibers, more particularly reinforcement fibers, such as glass fibers.

It is noted that "soft PVC" is a term expressing that this relates to supple PVC, in other words, PVC which is relatively smoothly bendable. The term soft PVC is widely known in the technique. Such soft PVC consists of PVC which has been softened, preferably by means of a plasticizer added during the production process. Depending on the added amount of plasticizer, of course different degrees of suppleness can be achieved.

By a plasticizer, any material must be understood which by being added results in a more supple PVC. Typical examples are phthalate plasticizers and isosorbide plasticizers.

By PVC which is softened, of course also PVC can be understood or a composition on the basis of PVC, which as such has the feature of being supple, for example, in that it is modified.

The same is valid for other "soft synthetic materials", and the above is not limited to PVC.

As already stated herein above, the present invention shows its advantages best when it is applied with floor panels which substantially are manufactured of supple or soft synthetic material, or in other words with supple panels.

By supple floor panels, floor panels are intended, which panels, when they, in the case of a rectangular panel, for example, with a width of less than 50 centimeters, are clamped on one of the two short sides of the panel and herein protrude over a length of 100 centimeters and are not supported, will bend under the influence of their own weight, wherein this bending at the height of the free extremity in respect to the clamped extremity is minimum 10 centimeters. For this bending, a bending time of 10 seconds is taken into account, and wherein the panel starts from a flat horizontal position.

The present invention is in no way limited to the embodiments described by way of example and represented in the figures; on the contrary, the floor panels of the aforementioned aspects can be realized according to various variants, without leaving the scope of the invention.

So, the invention can also be applied, for example, with synthetic material-based floor panels which have a composed substrate, which panels also can be called hybrid floor panels. More particularly, this herein relates to a floor panel which consists at least of two substrate layers, each of a well-defined thickness, namely a first synthetic material-based substrate layer and a second substrate layer, situated there above, preferably directly there above, which second substrate layer has a thickness of at least 0.5 mm, preferably at least 1 mm; wherein this composed substrate, the floor panel concerned, respectively, also shows one of the following characteristics or any combination of these characteristics:

- the density of the first substrate layer differs from the density of the second substrate layer, and preferably the second substrate layer has a higher density than the first substrate layer;
- the first substrate layer is foamed, and preferably is of the closed cell type and still more preferably of the so-called hard foam type, and preferably the second substrate layer is not foamed or is less foamed than the first substrate layer;
- the first substrate layer is extruded in plate shape or is formed to a plate by means of a strewing process and consolidation of the strewn material;
- the second substrate layer consists of an extruded layer or of a layer which is formed by means of a strewing process and consolidation of the strewn material;
- the two substrate layers are glued to each other or, alternatively, are consolidated in the same production process, this latter, for example, by mutual direct adhesion among the materials of the substrates, or, for example, also by forming them of one composed mass with at least two layers;

In preferred embodiments of such floor panel with a composed substrate, this further may have one or more of the following characteristics, wherein all not contradictory combinations of characteristics are possible:

- that the aforementioned first substrate layer comprises at least a thermoplastic material;
- that the aforementioned first substrate layer is realized at least on the basis of polyvinyl chloride, polyethylene, polyurethane, polypropylene or PIR, or a combination of the preceding;
- that the aforementioned first substrate layer is a filled synthetic material composite, wherein this filling preferably consists at least of one or of a combination of the following materials: bamboo, cork and/or wood, and more particularly one or a combination of the aforementioned materials in the form of chips and/or fibers and/or dust or powder, such as sawdust;
- that the aforementioned first substrate layer is foamed;
- that the aforementioned first substrate layer is of the closed cell-type;
- that the aforementioned first substrate layer comprises one or more plasticizers;
- that the aforementioned first substrate layer comprises fillers, such as chalk and/or limestone and/or talc;
- that the aforementioned first substrate layer is provided with at least one reinforcement layer, preferably of glass fiber or the like;
- that the aforementioned first substrate layer has a thickness of at least 3 mm, preferably at least 4 mm, and still more preferably at least 5 mm;
- that the aforementioned first and/or second substrate layer is realized water-resistant; that the aforementioned second substrate layer is based on synthetic material;
- that the aforementioned second substrate layer comprises at least a thermoplastic material, which preferably is of the soft type;
- that the aforementioned second substrate layer is realized at least on the basis of vinyl, such as polyvinyl chloride, more particularly soft polyvinyl chloride, polyethylene, more particularly soft polyethylene, polyurethane, polypropylene, PIR or a combination of the preceding;
- that the aforementioned second substrate layer substantially consists of one or a combination of the following materials: wood veneer, rubber, linoleum, a paper-based or foil-based laminate sheet, or alternatively any material, more particularly cork, bamboo or wood veneer, which is encased by vinyl or resin;
- that the aforementioned second substrate layer comprises one or more plasticizers; that the aforementioned second substrate layer comprises fillers, such as chalk and/or limestone;
- that the aforementioned second substrate layer is provided with at least one reinforcement layer, preferably of glass fiber or the like;
- that the floor panel comprises a backing layer, which preferably is situated directly underneath the first substrate layer, which backing layer, for example, is realized on the basis of one or more of the following materials: cork, rubber and/or a soft foamed layer;
- that the floor panel comprises a top layer, whether or not consisting of a plurality of layers, which preferably is situated directly above the second substrate layer, and/or that the second substrate layer is provided with a backing layer on the lower side of this second substrate layer;
- that the aforementioned top layer comprises at least a decorative layer, preferably in the form of a print, preferably provided on a foil or film;
- that the aforementioned top layer comprises at least a translucent or transparent wear layer and/or is provided with hard particles in order to increase the wear resistance, such as corundum;

that the floor panel has an overall thickness which is smaller than 10 mm, still better in the order of magnitude of 8 mm, or possibly thinner;

that the aforementioned first substrate layer is foamed gradually, wherein the degree of foaming increases in downward or in upward direction.

The invention claimed is:

1. A panel for forming a covering, wherein the panel substantially is realized on the basis of a synthetic material substrate;

wherein the panel is rectangular, either oblong or square, and comprises a first pair of opposite edges and a second pair of opposite edges;

wherein the panel, on the second pair of opposite edges, is provided with an edge configuration which allows that two of such panels can be positioned with their respective edges alongside each other;

wherein the panel, on the second pair of opposite edges, has an edge configuration which provides for that the panels extend along the second pair of opposite edges alongside each other in an overlapping manner;

wherein the edge configuration of the second pair of opposite edges is provided with adhesive means, which allow a connection between the edges;

wherein the configuration of the second pair of opposite edges is free from mechanical vertically active locking systems;

wherein the overlapping manner is an overlapping by a lower flange and upper flange at the second pair of opposite edges;

wherein the overlapping is arranged to allow contact at an upper edge between the respective panels;

wherein the upper and lower flanges are substantially flat;

wherein the adhesive means is provided in a recess of the lower flange.

2. The panel of claim 1, wherein the configuration of the second pair of opposite edges comprises a mechanical horizontally active locking system.

3. The panel of claim 1, wherein the configuration of the second pair of opposite edges comprises coupling parts which are realized as hook-shaped elements, wherein said hook-shaped elements are the lower flange and the upper flange.

4. The panel of claim 3, wherein the second pair of opposite edges is formed by edge configurations, which are realized in one piece of the material of the panel, and the substrate thereof, with an exception of any adhesive provided thereon.

5. The panel of claim 1, wherein the panel shows one or more of the following characteristics:

each of the upper and lower flanges has a thickness larger than ⅓ of an overall thickness of the panel;

the upper and lower flanges are realized in one piece with the panel;

the lower flange is realized as a separate part and attached to the panel, partially on a lower side thereof in a recess;

the overlapping is made possible in that on one of the edges of the second pair of opposite edges, a protruding flap is provided, which is attached to the lower side of the panel, on which, in an installed condition, another panel is placed;

said flap is realized as a strip of a foil-like or film-like material;

the overlapping extends over a distance which is larger than the thickness of the panel;

at a bottom side, there is a space between the panels when they are adjusted with their upper edges against each other;

at the bottom side, there is no space between the panels when they are adjusted with their upper edges against each other.

6. The panel of claim 1, wherein it shows one or more of the following characteristics:

adhesive means is present on one of the edges only;

adhesive means is present on both edges;

adhesive means are present on both edges and, in installed condition, in contact with each other;

adhesive means is present between vertical or substantially vertical and/or between horizontally and/or substantially horizontally directed surfaces;

the adhesive means provides at least for a vertical connection;

the adhesive means provides at least for a horizontal connection;

the adhesive means is provided in a seat.

7. The panel of claim 1, wherein the overlapping manner is an overlapping by means of a lower flange and upper flange at the second pair of opposite edges and wherein the adhesive means are present on the lower flange.

8. The panel of claim 1, wherein the adhesive means show one or more of the following characteristics:

it is self-adhesive by a pressure-sensitive adhesive;

it relates to a two-component glue;

the adhesive means is present in the form of glue strips;

the adhesive means is present as a strip which is provided on the panel and is provided with adhesive means on a turned-away side;

the adhesive means is sprayed on;

the adhesive means is provided with a removable protection layer.

9. The panel of claim 1, wherein the coupling parts of the second pair of opposite edges are configured such that two of such panels can be coupled to each other at the second pair of opposite edges by means of a downward movement.

10. The panel of claim 1, wherein the panel is a panel for a floor covering.

11. The panel of claim 1, wherein the substrate is layer-shaped, either single-layer or multi-layer.

12. The panel of claim 1, wherein the substrate comprises fillers.

13. The panel of claim 12, wherein the fillers are selected from the group consisting of chalk, talc, and limestone.

14. The panel of claim 1, wherein the panel is less than 5 mm thick.

15. The panel of claim 1, wherein the panel is bonded by means of adhesive means to an underlying surface.

16. The panel of claim 1, wherein the upper and lower flanges are formed as separate components affixed at the panel.

17. A panel for forming a covering, wherein the panel substantially is realized on a basis of a synthetic material substrate;

wherein the panel is rectangular, either oblong or square, and comprises a first pair of opposite edges and a second pair of opposite edges;

wherein the panel, on the second pair of opposite edges, is provided with an edge configuration which allows that two of such panels can be positioned with their respective edges alongside each other;

wherein the panel, on the second pair of opposite edges, has an edge configuration which provides for that the panels extend along the second pair of opposite edges alongside each other in an overlapping manner; and wherein the edge configuration of the second pair of opposite edges is provided with adhesive means, which allow a connection between the edges;

wherein the configuration of the second pair of opposite edges is free from mechanical vertically active locking systems;

wherein the configuration of the second pair of opposite edges comprises a mechanical horizontally active locking system;

wherein the overlapping manner is an overlapping of a lower flange and upper flange at the second pair of opposite edges; and wherein the configuration of the second pair of opposite edges comprises coupling parts which are realized as hook-shaped elements, wherein said hook-shaped elements are the lower flange and the upper flange; and wherein the adhesive means is provided with a removable protection layer;

wherein the overlapping extends over a distance which is larger than a thickness of the panel.

18. A panel for forming a covering, wherein the panel substantially is realized on a basis of a synthetic material substrate;

wherein the panel is rectangular, either oblong or square, and comprises a first pair of opposite edges and a second pair of opposite edges;

wherein the panel, on the second pair of opposite edges, is provided with an edge configuration which allows that two of such panels can be positioned with their respective edges alongside each other;

wherein the configuration of the second pair of opposite edges is free from mechanical vertically active locking systems and free from mechanical horizontally active locking systems;

wherein on one of the edges of the second pair of edges a protruding flap is provided, which is attached to a lower side of the panel;

wherein the protruding flap is formed as a strip of a foil-like or film-like material.

19. The panel of claim 18, wherein the protruding flap is attached to the lower side of the panel by means of an adhesive.

* * * * *